United States Patent [19]

Stahl et al.

[11] Patent Number: 4,630,035

[45] Date of Patent: Dec. 16, 1986

[54] ALARM SYSTEM HAVING ALARM TRANSMITTER INDENTIFICATION CODES AND ACOUSTIC RANGING

[75] Inventors: John I. Stahl, Coral Springs; Burton J. Fischel, Plantation; Frank J. Will, Sunrise, all of Fla.

[73] Assignee: Motorola, Inc., Schaumburg, Ill.

[21] Appl. No.: 688,834

[22] Filed: Jan. 4, 1985

[51] Int. Cl.[4] ..... G08B 1/08

[52] U.S. Cl. ..... 340/539; 340/307; 340/345; 340/522; 340/531; 342/44

[58] Field of Search ..... 340/539, 531, 506, 533, 340/534, 500, 522, 345, 346; 455/9, 38, 51, 53, 56, 65; 343/6.8 R, 6.8 LC, 6.5 R, 12 R, 15; 367/197–199, 118, 127

[56] References Cited

U.S. PATENT DOCUMENTS

| | | | |
|---|---|---|---|
| 3,440,635 | 4/1969 | Hull . | |
| 3,747,057 | 7/1973 | Brougher . | |
| 3,902,478 | 9/1975 | Konopasek et al. | 340/539 |
| 3,922,678 | 11/1975 | Frenkel . | |
| 3,925,763 | 12/1975 | Wadhwani et al. | 340/539 |
| 4,101,872 | 7/1978 | Pappas | 340/539 |
| 4,153,881 | 5/1979 | Permut et al. | 340/539 |
| 4,162,488 | 7/1979 | Silverman et al. | 340/505 |
| 4,189,720 | 2/1980 | Lott . | |
| 4,225,953 | 9/1980 | Simon et al. . | |
| 4,347,501 | 8/1982 | Akerberg | 340/539 |
| 4,357,602 | 11/1982 | Lemelson . | |
| 4,367,458 | 1/1983 | Hackett | 340/539 |
| 4,406,995 | 9/1983 | May . | |
| 4,442,426 | 4/1984 | Heuschmann et al. | 340/539 |
| 4,446,454 | 5/1984 | Pyle . | |
| 4,450,436 | 5/1984 | Massa . | |
| 4,462,022 | 7/1984 | Stolarczyk | 340/539 |
| 4,523,184 | 6/1985 | Abel | 340/531 |

*Primary Examiner*—Donnie L. Crosland

*Attorney, Agent, or Firm*—Mark P. Kahler; Joseph T. Downey; Edward M. Roney

[57] ABSTRACT

An alarm system for sensing an alarm condition within a relevant alarm area includes one or more portable alarm units for sensing an alarm condition. Each alarm unit includes a radio frequency transmitter for identifying the alarm unit and a secondary, audio, transmitter for defining the relevant alarm area. The system also includes a plurality of transponders. Each transponder includes a primary receiver for receiving a radio message from an alarm unit and a secondary receiver for receiving an audio signal from the alarm unit. A real-time clock in each transponder provides the elapsed time between receipt of a primary and receipt of the secondary alarm signals. The alerted transponders then transmit to a control unit a transponder address code, an alarm unit identification code and an elapsed time indicia. Based on the address code or codes and the minimal elapsed times detected by the control unit, the relevant alarm area can be determined.

19 Claims, 4 Drawing Figures

ALARM SYSTEM HAVING ALARM TRANSMITTER INDENTIFICATION CODES AND ACOUSTIC RANGING

FIELD OF THE INVENTION

The present invention relates generally to security systems and more particularly to an improved wireless security system which utilizes transmitted identification codes and acoustic ranging for accurately locating an alarmed transmitter.

BACKGROUND OF THE INVENTION

There are many environments wherein security systems are employed for the protection of security personnel. Such environments include warehouses or other similar storage facilities where security personnel are employed to prevent theft of merchandise or other stored materials. Another environment where such security systems are employed is in institutions. These include penal institutions or other high security government or private facilities where security personnel are employed to control access to restricted areas by unauthorized persons.

Security systems used in environments of the type mentioned above are required to sense an alarm condition, such as when a security guard is under attack or is otherwise in need of assistance and then locate the relevant alarm area where the alarm condition arose. Accurately locating the relevant alarm area is particularly important because it allows efficient deployment of additional security personnel for responding to the alarm condition.

Although there are many types of security systems, wireless security systems are widely used because of the flexibility in employment and use afforded by such systems. Such systems generally include a central control where security personnel monitor the condition of a plurality of portable alarm transmitters carried by the security personnel throughout the protected facility. Each alarm transmitter is assigned an identification code and includes a transmitter for transmitting the identification code when the alarm transmitter is activated by the wearer. The central control includes a look-up table which relates each identification code to an area of the facility where the wearer, and thus the alarm transmitter, is most likely to be.

When an alarm condition exists, the alarm condition is sensed by one of the alarm transmitters by, for example, the depression of an activation button by the wearer or by a tilt switch and it transmits its identification code by radio frequency signals to the central control. The central control then uses the look-up table to match the received alarm transmitter identification code to the area of the facility where the alarm transmitter is most likely to be and provides the security personnel with that location. The central control can provide the most likely location of the alarm transmitter on either a printout or on a cathode ray tube map display.

In some systems, the alarm transmitters transmit their respective identification code to the central control indirectly through one or more transponders. In such systems, the alarm transmitters are usually low power transmitters having a limited range which is insufficient for the central control to receive the identification codes. The transponders on the other hand are high power transmitters and receive the alarm transmitter identification codes and relay them to the central control. Each of the transponders can also be assigned an address code and relay both the alarm transmitter identification code and their own address code to the central control when an alarm condition exists.

Prior art systems of the type described above are generally not able to provide an accurate location of an alarmed transmitter. The reason for this is that the alarm transmitters are portable and the security personnel wearing the same are not always able to be in the area corresponding to the identification codes. As a result, when an alarm condition exists, there is always the possibility that the relevant alarm area is not the location where the alarmed transmitter is most likely to be.

It is therefore a general object of the present invention to provide a new and improved security system.

It is a more particular object of the present invention to provide such a system which affords more accurate location of an alarmed transmitter within a protected facility.

It is a more specific object of the present invention to provide such a system which combines transmitted alarm transmitter identification codes and acoustic ranging of the alarmed transmitters to afford more accurate location of the alarmed transmitters.

It is a further object of the present invention to provide a method of sensing an alarm condition in a relevant area and of locating the relevant alarm area.

It is a further object of the present invention to provide an improved alarm transmitter.

SUMMARY OF THE INVENTION

In accordance with the present invention an apparatus and a method are provided for sensing an alarm condition within a relevant alarm area. In one embodiment of the invention, the alarm system includes at least one alarm means for sensing an alarm condition and adapted to transmit an alarm signal upon sensing said alarm condition, and a plurality of transponders. At least some of the transponders are located within receiving range of the alarm signal. Each transponder is assigned an address code and includes receiving means for receiving the alarm signals, recording means for recording the time of receipt of a received alarm signal, and transmitting means for transmitting a signal including the address code and the recorded time of receipt of a received alarm signal.

In a further embodiment of the invention, the system can include a control means for receiving the transponder signals and for locating the relevant alarm area based upon the sensed transponder address codes and the time of receipt of the alarm signals by the transponders. The control means can in a further embodiment of the invention include a programmed processor.

In a further embodiment of the invention the alarm signals can be coded in a predetermined fashion. In embodiments of the invention, the alarm signals can be transmitted as audio or ultrasonic signals.

In accordance with the present invention, a method is also provided for sensing an alarm condition within a relevant alarm area and locating the relevant alarm area. The method can include the steps of sensing an alarm condition and transmitting an alarm signal upon sensing the alarm condition, receiving the alarm signal at a plurality of locations, recording the time of receipt of the alarm signal at each of the plurality of locations, transmitting a signal from each of the plurality of locations including an address of each such location and the recorded time of receipt of the alarm signal at each such location, receiving each such signal at a central control point, and locating the relevant alarm area at the central control point based upon the address signals and the time of receipt signals.

In a further embodiment of the invention the alarm signals can be generated as coded signals. In yet other embodiments of the invention the alarm signals can be generated as acoustic or ultrasonic signals.

Further in accordance with the invention, an improved alarm unit is provided. In a portable alarm unit having a relatively low-power radio transmitter and associated control circuitry, the improvement includes a secondary transmitter coupled to an alarm condition sensing switch. When the switch, which can include a conducting liquid, indicates that an alarm condition has occured, both the ratio transmitter and the secondary transmitter can be activated.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, in the several figures of which like reference numerals identify identical elements, and wherein:

DESCRIPTION OF THE PREFERRED EMBODIMENTS

Figure 1:
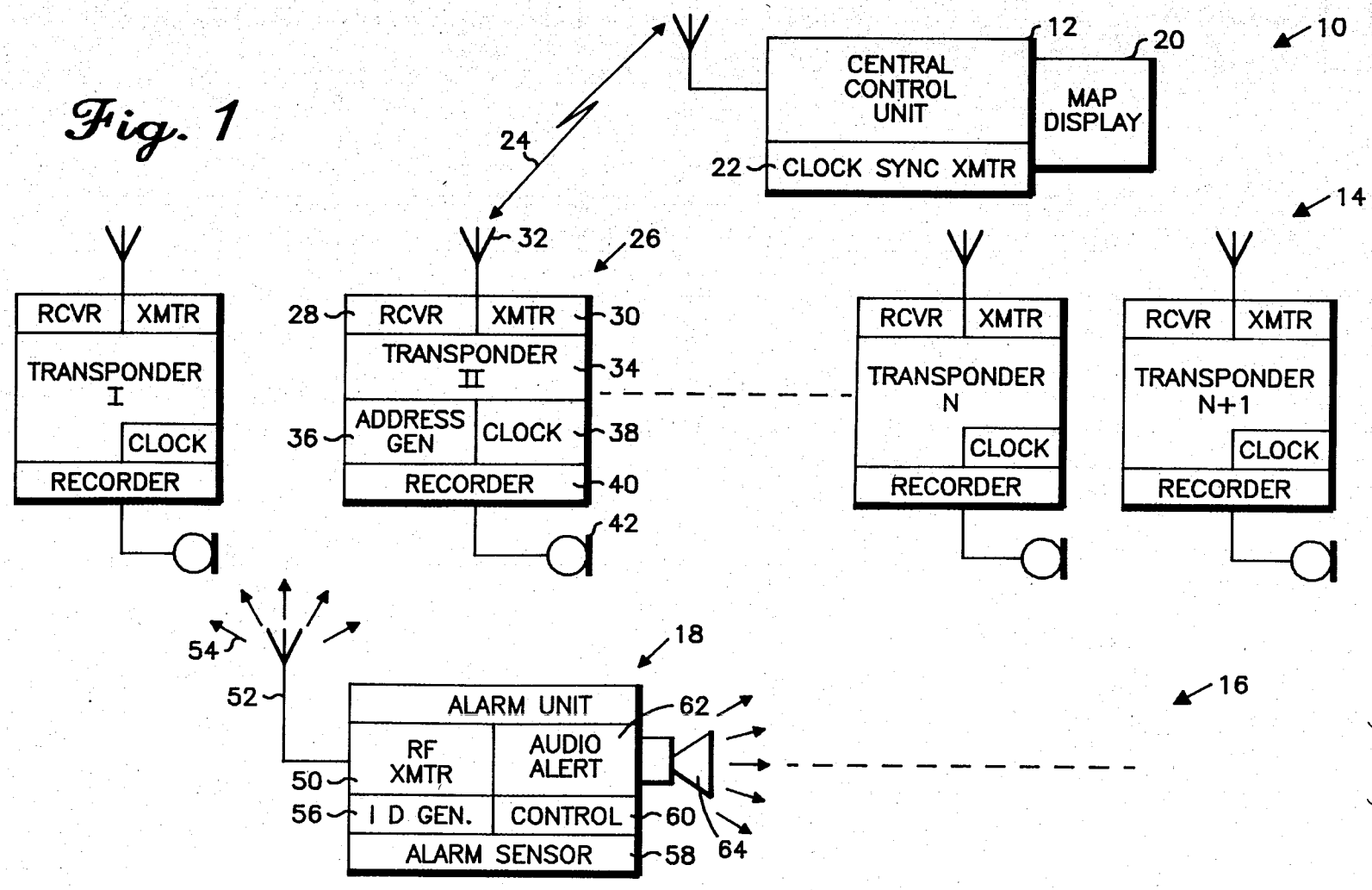
FIG. 1 is a block diagram of an alarm system in accordance with the present invention.

In accordance with the present invention, and with respect to the Figures, FIG. 1 illustrates an exemplary alarm system 10 for sensing an alarm condition within a relevant alarm area and for locating the relevant alarm area. The system 10 includes a central control unit 12 which can be located physically in a control room of an appropriately secure area. The system 10 also includes a plurality of transponders 14 which are physically and fixedly mounted or located throughout the area or space wherein the alarm conditions may occur. The system 16 also includes a plurality of alarm units which are portable and which can be readily carried by appropriate personnel. An alarm unit 18 is a typical member of the plurality 16.

More particularly, the central control unit 12 includes a map or area display unit 20 which can include a plurality of lightable lights to specify relevant alarm areas. Alternately, instead of a display unit, such as the unit 20, a printer or other output device could be used for the purpose of specifying an alarm area. The central control unit 12 also includes a clock synchronization transmitter 22 whose function will be discussed subsequently.

The exact implementation of the central control unit 12 is not a limitation of the present invention. The unit 12 could be implemented as a hard-wired logic system or preferably as a programmable processor. In one mode of implementation of the central control unit 12, a microprocessor of a known or conventional variety could be used with a control program fixed in an associated read-only memory. As will be understood by those of skill in the art, the exact details of the control unit 12 are not a limitation of the present invention.

The control unit 12 communicates with the members of the plurality of transponders 14 through a bidirectional radio frequency link indicated symbolically at 24. Each of the transponders in the plurality 14 can be identical and the following description of a typical transponder 26 is applicable to each of the members of the plurality 14.

The transponder 26 includes a radio frequency receiver 28. The transponder 26 also includes a transmitter 30 designed to communicate via an antenna 32 with the central control unit 12 via the radio frequency link 24. The receiver 28 and transmiter 30 are conventional receivers and transmitters of a type normally used with security transmission systems. It is to be emphasized and will be understood by those of skill in the art that the details of the communication link 24, the receiver 28 or the transmitter 30, do not represent a limitation of the present invention.

The transponder 26 further includes a control unit 34 of a conventional variety capable of receiving test information via the RF link 24 from the control unit 12. The unit 34 in combination with the transmitter 30 is also capable of formating messages to be sent via the link 24 to the central control unit 12. The unit 34 includes a settable address generator 36 such that each of the transponders, such as transponder 26, can be assigned a unique, transmittable, address code. This address code can be looked up by the central control unit 12 and can be used to either light a light on the display unit 20 or generate an alphanumeric message on an output printer.

The unit 34 also includes a real-time clock 38 which can be used to keep track of elapsed time from some arbitrary starting point. The unit 34 can include message detection circuitry which can sense and interpret messages from the control unit 12 received via the transmission link 24.

With respect to the present invention, the clock synchronizing transmitter 22, under the control of the control unit 12, can on a predetermined basis, send synchronization signals to the transponder 26 via the communication link 24. These synchronization signals are sensed by the unit 34 of the transponder 26 and used to synchronize the setting of each clock 38.

The clock 38 can be arbitrarily reset to some starting point, such as 0, or can be set to the actual time as recorded in the control unit 12. So long as each of the clocks 38 is synchronized to a known value by the clock synchronization transmitter 22, the exact type of synchronization is not a limitation of the present invention.

Each of the transponders, such as the transponder 26, also includes a recorder 40. The recorder 40 includes a sensor 42 for sensing secondary signals generated by one or more of the alarm units, such as the alarm unit 18. For example, as illustrated in the transponder 26, the secondary transmission sensor 42 is a microphone.

The sensor or transducer 42 can be any sensor which is capable of detecting a signal arriving at the transponder 26 at a rate substantially less than the RF signal received from the alarm unit, such as the alarm unit 18.

For example and without limitation, the sensor 42 could be a microphone for receiving audio signals or tones or an ultrasonic transducer for sensing ultrasonic waves.

The system 10, as noted above, also includes the plurality of portable alarm units 16. Each of the alarm units is identical and the alarm unit 18 is typical thereof. The following discussion of the alarm unit 18 is applicable to each of the members of the plurality 16.

It will be understood that the intent of the alarm unit 18 is to be small enough and light enough to be worn by a person whose job may require movement in the area which is bounded by the range of the plurality of transponders 14. Each of the alarm units 18 includes a conventional, low power, radio frequency transmitter 50. The transmitter 50 is coupled to an antenna 52. By means of an RF transmission link indicated symbolically at 54, each alarm unit, such as the unit 18 can communicate with the transponders such as the transponder 26. Each of the alarm units 18 also includes a settable identification code generator 56 of a type known in the art. The generator 56 can be set such that the transmitter 50 will transmit a unique identification code for each of the alarm units, such as the unit 18. The transmitted identification codes communicated via the link 54 can be received by one or more of the transponders, such as the transponder 26. Transmission by the transmitter 50 can be initiated manually by the wearer of the alarm unit 18 by depressing a button. Such manual depressions can be for the purpose of testing the alarm unit 18 or for the purpose of calling assistance.

To enhance the security of the person wearing the alarm unit 18, the unit 18 also includes an alarm sensor 58. The sensor 58 is intended to sense any ususual physical condition, for example if the physical orientation of the alarm unit 18 is suddenly changed.

In an embodiment of the invention, and without limitation, the alarm sensor 58 could be a mercury filled switch designed to either open or close if the orientation of the alarm unit 18 is changed substantially from its normal orientation when the wearer is standing or sitting. The unit 18 also includes control circuitry 60 of a conventional variety which is adapted to receive a signal from the alarm sensor 58 and immediately activate the transmitter 50. The transmitter 50 can then send the identification code generated by the identification code generator 56, via the link 54 to one or more of the transponders in the plurality 14.

The alarm unit 18 also includes an audio alert circuit 62. The function of the circuit 62, under the control of the control electronics 60, is to generate the secondary alarm signal. As noted above, this signal can be an audio or ultrasonic signal.

The secondary alarm signal can be, without limitation, an arbitrary ultrasonic signal or an encoded audio code either sent in bursts or with an alternating duration. As a further alternate, the secondary signal, if audio, could be sent with alternating pitch or at a non-voice audio frequency in a range of 10 kilohertz or above.

The actual form of the secondary transmission is not a limitation of the present invention. What is required is that the secondary transmission have a transmission rate substantially less than the speed of light such that the signal from the ratio frequency transmitter 50 arrives at one or more of the transponders, such as the transponder 26, substantially before the secondary signal arrives. Coupled to the audio alert circuit 62 is an output transducer 64 which could be, for example, a speaker if audio signals are used.

In operation, if an alarm initiating incident occurs one of the alarm units, such as alarm unit 18, perhaps having been triggered by an alarm sensor such as the alarm sensor 58, will immediately transmit via the transmitter 50 an identification code to one or more of the transponders. Those transponders which sense the radio frequency signal from the activated alarm unit, such as 18, at the recorder 40, record the then current value of the real-time clock 38. When the secondary signal arrives from the transducer 64, at one or more of the transponders such as the transponder 26, a second reading is made of the real-time clock 36 by the control electronics 34.

Those of the transponders which have sensed both an RF transmission from an alarm unit, such as the unit 18, as well as a secondary transmission, from an alarm unit, then transmit a signal, via the transmitter 30 and the link 24 to the control unit 12. This signal can include the transponder address code, the alarm unit identification code, and in a predetermined fashion, a time interval. This time interval corresponds to the time interval sensed by the real-time clock 36 between when an RF signal arrived at the transponder from an activated alarm unit and when a secondary signal was detected by the transponder.

The central control unit 12 may receive a plurality of messages from one or more of the transponders such as the transponder 26. Using a prestored table the control unit 12 can determine the geographical location of the transponder or transponders which have provided the alarm messages. The control unit 12 can then determine those transponders whose associated alarm messages include minimal elapsed times between when an RF signal was received from an activated alarm unit and when a secondary signal was received from the alarm unit. The relevant alarm area can then be located as being that area corresponding to the minimal elapsed time, as sensed by the real-time clocks, such as the real-time clock 36, in the group of transponders which has communicated with the control unit 12. Appropriate action can then be immediately taken to deal with the incident.

Figure 2:
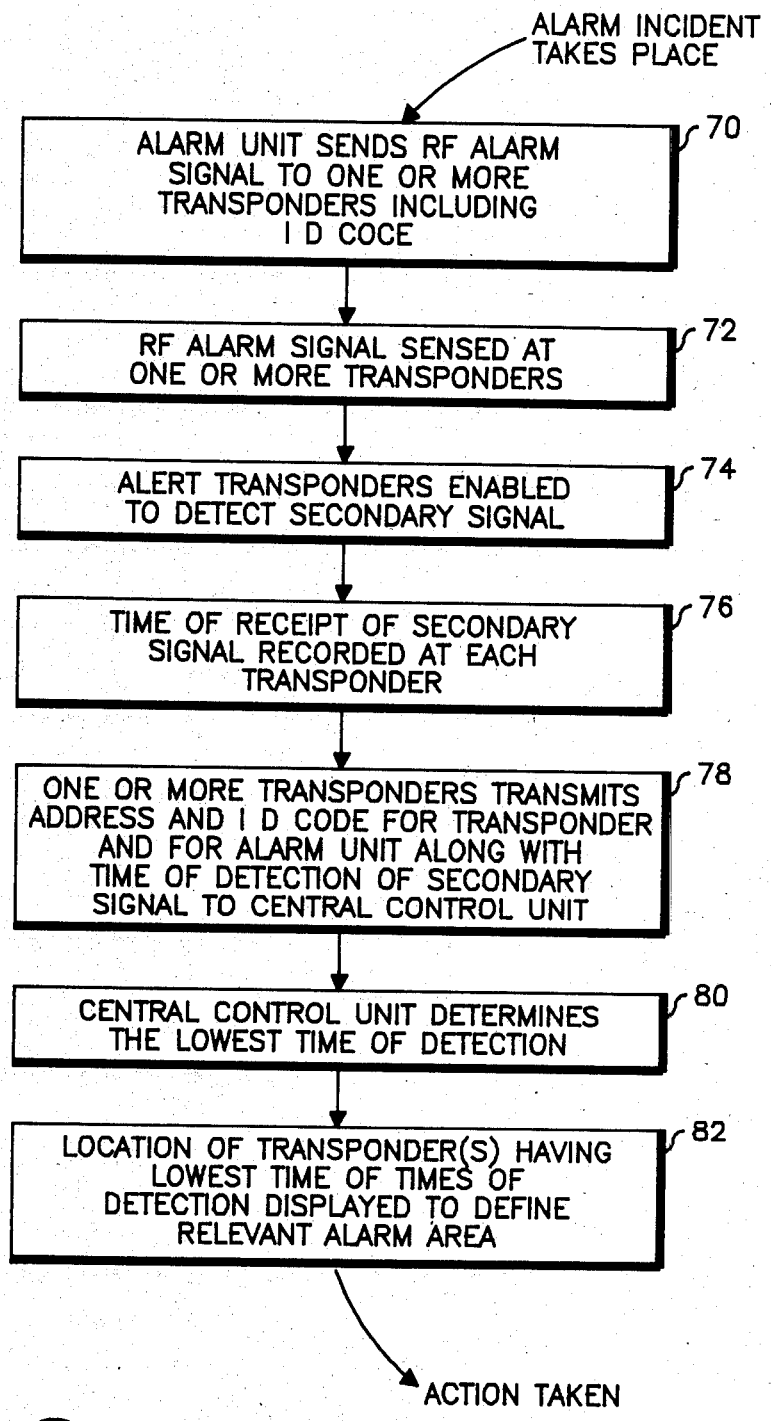
FIG. 2 is a flow diagram of a method of determining a relevant alarm area in accordance with the present invention.

FIG. 2 illustrates a flow diagram of the method of the present invention. As illustrated in FIG. 2, in a step 70, when an alarm incident occurs the alarm unit which has sensed the alarm condition transmits an RF alarm signal. This alarm signal is received by those transponders which are in range of the RF transmitter, such as the transmitter 50, of the alarm unit 18. In a step 72, one or more of the transponders, such as the exemplary transponder 26, senses the RF alarm signal from the alarm unit 18. Upon receipt of the alarm signal on the RF channel from the alarm unit 18 the transponder will also have received the identification code of the alarm unit which initiated the alarm. In a step 74, those transponders that have received the RF message are enabled to detect the elapsed time between when the primary, radio frequency signal, was sensed in the step 72 and when the secondary signal is sensed.

In step 76 the time of receipt or the time of sensing of the secondary alarm signal is recorded at each transponder which is in range thereof. In a step 78 one or more of the transponders transmits a signal via the link 24 to the control unit 12. This signal includes the transponder's address code, the identification code for the activated alarm unit, such as the alarm unit 18, as well as the time of detection of the secondary signal by the transponder.

In a step 80, the control unit 24 determines the lowest or shortest elapsed time between when a corresponding RF alarm signal arrived and when a secondary alarm signal arrived at a respective transducer. In a step 82, the relevant alarm area is determined based on the location of one or more transponders having the shortest elapsed times or times of receipt between when the primary radio frequency alarm signal arrived and when the secondary alarm signal arrived. The relevant alarm area can then be displayed on a amp display, such as the map display 20. Alternately, the relevant alarm area can be printed in alphanumeric form by a printer. Appropriate action may then be taken.

Figure 3:
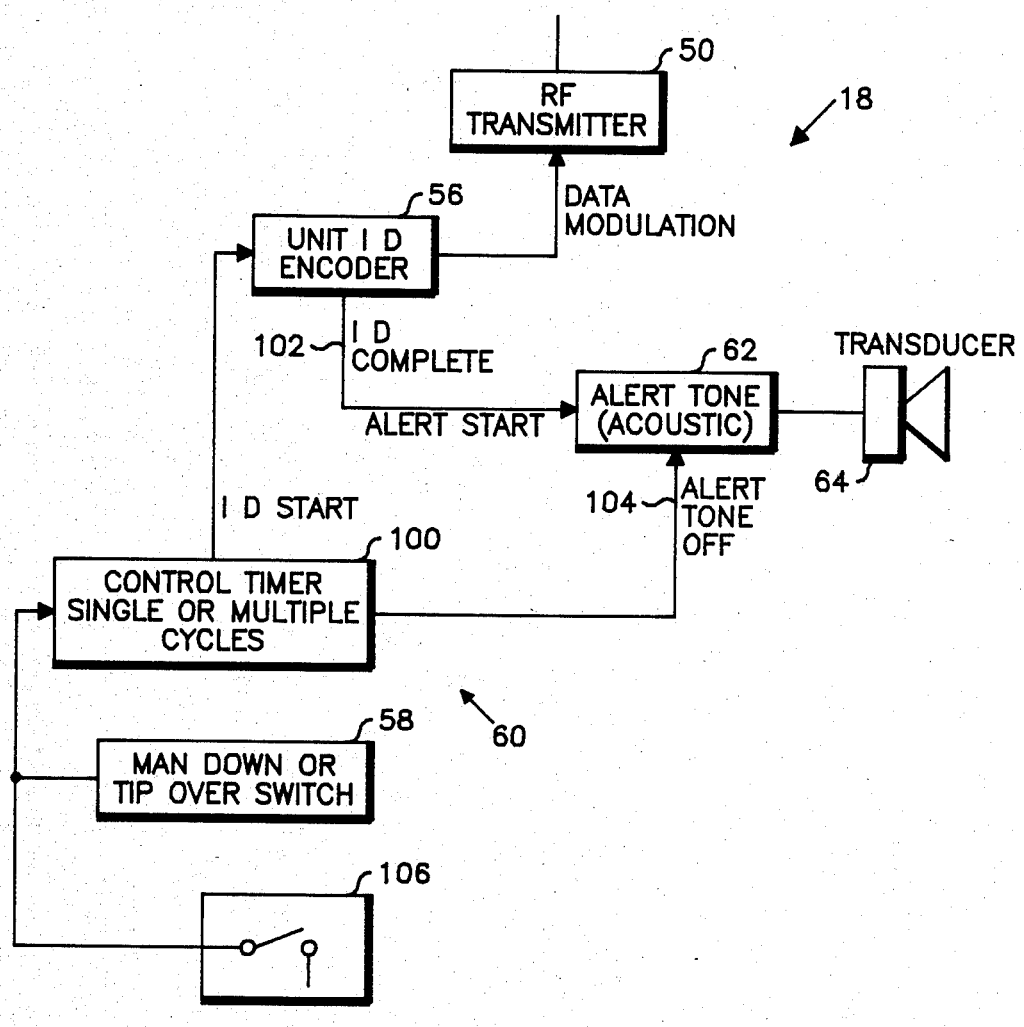
FIG. 3 is a block diagram of an alarm unit in accordance with the present invention.

FIG. 3 illustrates an exemplary block diagram for the alarm unit 18. Elements in FIG. 3 that appeared in FIG. 1 bear the same identification numerals as in FIG. 1. As may be seen from FIG. 3 the alarm sensor 58 may be implemented in the form of a mercury filled tip-over switch 58. Closing or opening of the switch 58 provides an alarm indicator signal to the control electronics 60. The control electronics 60 includes a control timer 100. The function of the control timer 100 is to control whether or not individual or multiple cycles of messages are transmitted to the plurality of transponders. The control timer 100 is in turn coupled to the identification code generator 56 which can be implemented as an encoder circuit. The output from the encoder circuit 56 can be modulated and transmitted via the transmitter 50. Modulation can take place within the transmitter 50 or in an external modulator.

When the alarm message transmission has been completed, the ID encoder 56 can generate an ID complete signal on a line 102 which triggers the audio alert circuit 62. The audio alert circuit 62 in turn drives the selected transducer 64. The control timer 100 via a line 104 can have the ability to terminate generation of the secondary transmission if desired.

The secondary alarm frequency can be any frequency compatible with the environment. For security systems, the secondary signal frequency would probably be also usable as an audio annunciator to summon local assistance. If the system is used for theft detection, the secondary signal frequencies generated by the transducer 64 would preferably be upper range audio frequencies, above 20 kilohertz, such as ultrasonic signals, so that a thief stealing the protected item would not be alert to the generation of the secondary signal and the item could be tracked through the facility.

The identification code generated by the encoder 56 and transmitted via the transmitter 50 to one or more of the transponders can be in any format desired. Typical conventional formats include DTMF, MD6600 Unitone or other digital formats.

The unit 18 can also include a push button test switch 106 for the purpose of manually testing the unit 18. The transducer 64 is preferably a high efficiency unit which is designed to match the selected audio or ultrasonic frequency. The power source for the unit 18 would be a built-in battery.

Figure 4:
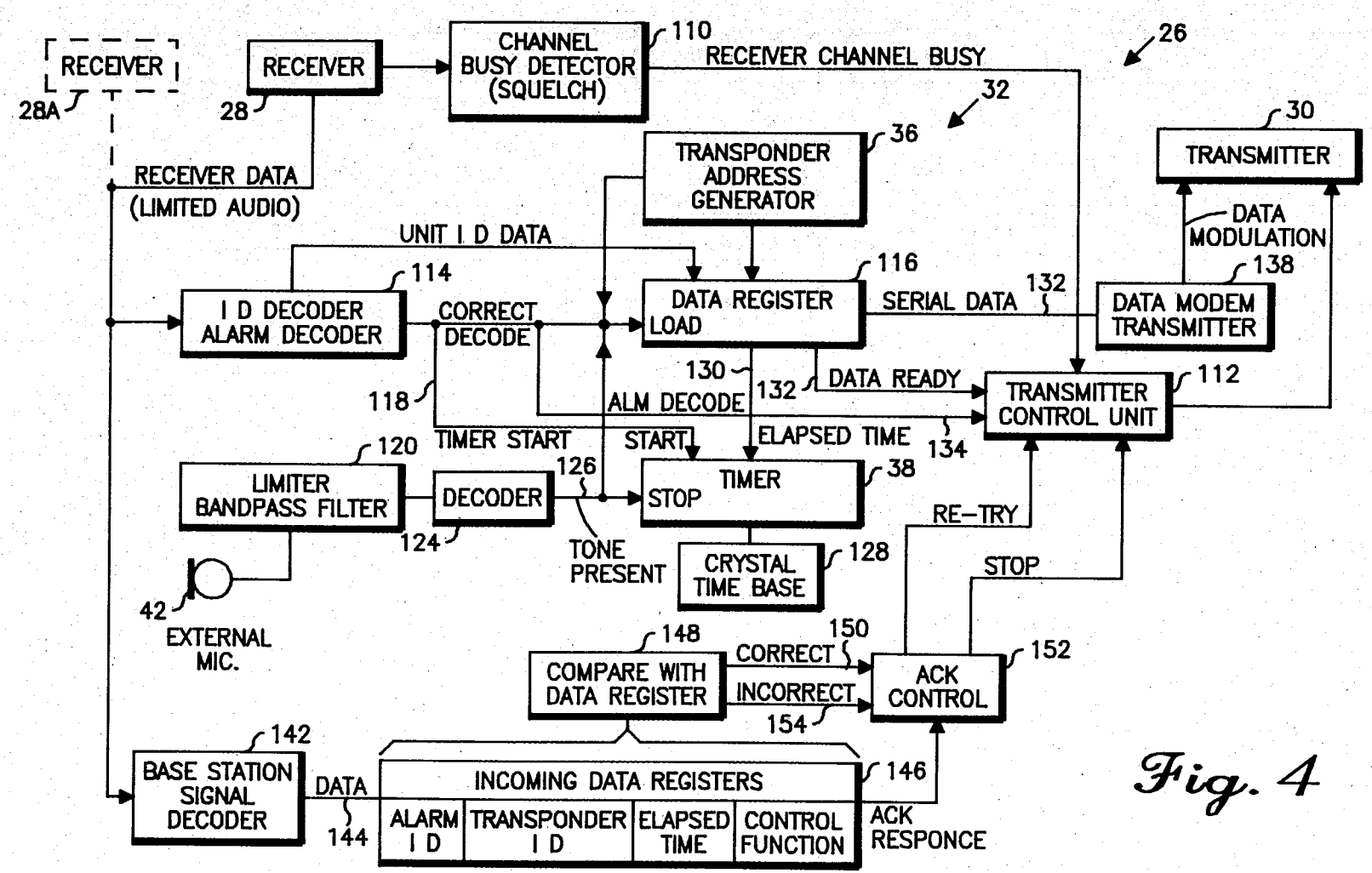
FIG. 4 is a block diagram of a transponder in accordance with the present invention.

FIG. 4 illustrates an exemplary block diagram of the transponder 26. Elements in FIG. 4 that appeared in FIG. 1 bear the same identification numerals as in FIG. 1. As can be seen from FIG. 4 the receiver 28 is electrically connected to a squelch circuit 110. The squelch circuit 110 is adapted to block transmission by the transmittor 30 in the event that the receiver 28 is receiving a signal from either an alarm unit, such as the alarm unit 18 or the control unit such as the control unit 12. The receiver 28 may be supplemented by a second receiver **28*a*** which can be used to maintain channel throughput if desired.

The receiver 28 is coupled to a decoder circuit 114 which decodes incoming messages and identification codes from an activated alarm unit. Output from the decoder circuit 114 is coupled to a data register 116 which receives the identification code for the activated alarm unit. The decoder 114 also initiates on a line 118 operation of the real-time clock or timer 38. The address generator 36 is also coupled to the data register 116 and provides the predetermined transponder address code.

Coupled to the sensor or microphone 42 is a band pass filter 120 which can include amplification and clipping of the sensed secondary signal as required. A detector or sensor 124 coupled to the band pass filter 120 generates a Tone Present signal on a line 126 which stops counting of the real-time clock or the timer 38. The timer 38 can be driven from a crystal controlled time base 128 to provide a precise measurement of time intervals. Elapsed time data on a set of lines 130 can be provided by the timer 38 to the data register 116. A Data Ready signal on a line 132, along with an Alarm Decoded signal on a line 134, enabled the transmitter control unit 112 to initiate transmission. Serial data on a line 136, from the data register 116, is then modulated by a modulator 138 and supplied to the transmitter 30 for transmission to the control unit 12.

In connection with incoming signals on the communication link 24 from the central control unit 12, the transponder 26 includes a base station signal decoder 142. The decoder 142 can generate a plurality of incoming data on a line or lines 144 which can then be loaded into an incoming data register 146. The incoming data register 146 can be used not only to provide control functions to the transponder 26 as required by the control unit 12 but also to enable the transponder 26 to implement a comparison and an acknowledge function.

A comparator 148 in the transponder 26 can compare portions of the data in the incoming data register 116, corresponding to the alarm address number, the transponder identification number and the elapsed time value previously formated in the data register 116 to the contents of the data register 116. In the event that the comparator 148 determines that the incoming data corresponds to the transmitted data from the data register 116, a Correct signal can be generated on a line 150 which in turn can control an acknowledge counter 152.

In the event that the comparator 148 determines that the incoming data in the register 146 is different from the transmitted data from the data register 116, an Incorrect signal generated on a line 154 can cause the acknowledge counter 152 to retry the transmission via the transmitter 112.

Using the above-described circuitry illustrated in FIG. 4, the transponder 26 will have the ability to sense the identification code for an activated alarm unit, such as the alarm unit 18, activate the real-time clock or timer 38 and measure the elapsed time between receipt or end of the transmission from the alarm unit 18 and receipt of the secondary signal or acoustic tone. The propagation time of the acoustic tone is on the order of 11 feet per millisecond.

The incoming data register 146 also includes a control function section which can provide for carrying out the acknowledge function, for self-testing, for providing public address system facilities and for turning a siren on or off. Synchronization of the real-time clock 38 can also be implemented as a control function. If the real-time clock 38 is a timer, synchronization is inherent in resetting the timer 38 by the Timer Start signal on the line 118.

The transmitter control unit 112 can include any additional acknowledge control required as well as a retry counter for additional transmissions if necessary. Further if desired, the transmitter control unit 112 could include a randomizing clock to diversify the transmission to increase its security.

The central control unit 112 is capable of receiving information transmitted on the link 24 from one or more transducers, such as a transducer 26. The central control unit 12 can interrogate the data, determine the identification codes for an activated alarm unit, the transducer address number, and the elapsed time. If the control unit 12 determines that the same identification code has been sensed from more than one transponder units the elapsed time can be checked to determine which transponder sensed the secondary signal the quickest. This transponder will be closest to the sight of the alarm unit.

The map display or display counsel 20 could be in a simple case nothing but a sequential printout of transponder address codes followed by each of the associated elapsed time values. An operator can then make a visual determination from the printout as to which transponder or transpondence were closest to the alarm incident.

An advantage of the present system is that the elapsed time values read out by the control unit 12 each define a circuit corresponding to a physical area of a determinable radius. A security guard or control operator could draw circles around each transponder location with a radius corresponding to the elapsed time value. If the alarm unit, such as the unit 18, is sensed by more than one transponder the overlapping circles will define the location of the alarm unit. If three transponders are involved a unique region will be defined. If two transponders are involved it is possible that two possible locations will be defined. A single involved transponder identifies a unique relevant alarm area. In a more elaborate system, the control unit 12 could include a map display which could show the location of the sensed alarm unit graphically.

The central control unit 12 can also include the ability to test each of the transponder units via the link 24, to provide control for local public address systems for announcements and to turn sirens on or off for personnel in the vicinity of the transponders as a warning. Additional control functions which can be implemented through the control unit 12 include locking electric doors, turning lights on or off or checking the condition of doors or windows.

It will be understood that while various message formats could be used in the transmissions between the alarm units and the transponders or the transponders and the control unit, the exact message formats are not a limitation of the invention. Similarly, while various modulation schemes could be used in such transmissions, the exact modulation scheme or schemes do not represent a limitation of the present invention.

It will be understood by those of skill in the art that the broader aspects of the invention include those various forms of primary or radio frequency transmission as are usable between the portable alarm units and the fixedly mounted transponders as well as those secondary forms of transmission usable between each of the alarm units and those transponders in range. Further it will be understood that the broader aspects of the invention also include the use of visual displays and table lookup techniques which permit definition of the relevant alarm area based on an elapsed time between when a primary, for example RF signal, is received and a secondary, perhaps acoustic signal is received.

What is claimed is:

1. An alarm system for sensing an alarm condition within a relevant alarm area and locating the relevant alarm area comprising:

at least one portable alarm means for sensing an alarm condition and adapted to transmit a primary radio frequency alarm signal including an identification code upon sensing said alarm condition, said at least one portable alarm means also being adapted to transmit a secondary audio alarm signal upon sensing said alarm condition;

a plurality of transponders, at least some of said transponders being location within receiving range of said primary and secondary alarm signals, each said transponder being assigned an address code and including receiving means for receiving said primary and secondary alarm signals, recording means for recording the time of receipt of said primary alarm signal and the time of receipt of said secondary alarm signal, and transmitting means for transmitting at least said address code and indicia of the time interval between the times of receipt of the primary and secondary alarm signals by each transponder within said receiving range; and control means for receiving signals from one or more of said transponders and for locating said relevant alarm area based upon said transponder address codes and said time intervals, said time intervals indicating the distances between a particular alarm means and respective transponders.

2. An alarm system as defined in claim 1 wherein each of said plurality of transponders includes means for determining said time interval between the time of reception of said primary and secondary alarm signals by said transponder.

3. An alarm system as defined in claim 1 wherein said at least one alarm means includes transmitting means for transmitting said secondary alarm signal at ultrasonic frequency.

4. An alarm system as defined in claim 1 wherein said control means includes means for locating said relevant alarm area by determining which of the transponders within range of the primary and secondary signals experienced the shortest time interval between reception of said primary and secondary alarm signals.

5. An alarm system as defined in claim 4 wherein each said transponder includes a clock and wherein said transponder clocks are synchronized with each other.

6. An alarm system as defined in claim 5 wherein said transponder clocks are synchronized by said control means.

7. A system as defined in claim 6 wherein said control means includes means for transmitting clock synchronizing signals to said transponders.

8. A system as defined in claim 1 wherein said transponders are located at fixed locations.

9. A method of sensing an alarm condition within a relevant alarm area and locating the relevant alarm area comprising:

sensing an alarm condition;

transmitting a primary radio frequency alarm signal upon sensing said alarm condition, such transmitting originating from within said relevant alarm area;

transmitting a secondary audio alarm signal upon sensing said alarm condition, such secondary alarm signal being transmitted from the same location as said primary alarm signal;

receiving said primary and secondary alarm signals at a plurality of locations;

recording the time of receipt of the primary and secondary alarm signals at each of said plurality of locations;

transmitting data signals from each of said plurality of locations including an address of each said location and the recorded times of receipt of said primary and secondary alarm signals at each said location;

receiving said data signals from said plurality of locations at a central control point; and locating said relevant alarm area at said central control point based upon said address signals and said times of receipt.

10. A method as defined in claim 9 wherein said primary and secondary alarm signals are coded alarm signals.

11. A method as defined in claim 9 wherein said secondary alarm signal is an ultrasonic alarm signal.

12. A method as defined in claim 9 including the step of determining the time interval, at each of said plurality of locations, between the time of receipt of said primary alarm signal and the time of receipt of said secondary alarm signal, thus generating a plurality of time intervals, each time interval corresponding to a respective one of said plurality of locations.

13. A method as defined in claim 12 wherein said step of locating said relevant area is performed by determining the shortest of said plurality of time intervals.

14. A method as defined in claim 9 further including providing each said plurality of locations with a clock and synchronizing said clocks with each other.

15. A method as defined in claim 14 further including synchronizing said clocks from said central control point.

16. A method as defined in claim 15 including the further step of transmitting clock synchronizing signals from said central control point to said clocks.

17. A method as defined in claim 9 including the further step of transmitting an identification code signal with said primary and secondary alarm signals upon sensing said alarm condition.

18. A method as defined in claim 17 including the further step of receiving said identification code signal at each of said plurality of locations.

19. A method as defined in claim 18 including the further step of transmitting said identification code signal from each of said plurality of locations to said central control point.

* * * * *